US007925186B2

(12) United States Patent
Miyata et al.

(10) Patent No.: US 7,925,186 B2
(45) Date of Patent: Apr. 12, 2011

(54) DEVELOPING DEVICE AND IMAGE-FORMING APPARATUS

(75) Inventors: Hideaki Miyata, Kanagawa (JP); Kei Hirata, Kanagawa (JP); Takashi Sakamoto, Kanagawa (JP); Kiyoshi Chatani, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 199 days.

(21) Appl. No.: 11/785,168

(22) Filed: Apr. 16, 2007

(65) Prior Publication Data

US 2008/0056770 A1 Mar. 6, 2008

(30) Foreign Application Priority Data

Sep. 4, 2006 (JP) ..... P2006-239567

(51) Int. Cl.
*G03G 15/08* (2006.01)

(52) U.S. Cl. ..... 399/253; 399/254; 399/99

(58) Field of Classification Search ..... 399/253
See application file for complete search history.

(56) References Cited

U.S. PATENT DOCUMENTS

| | | | | |
|---|---|---|---|---|
| 5,579,094 | A * | 11/1996 | Behe et al. | 399/99 |
| 5,878,317 | A | 3/1999 | Masuda et al. | |
| 5,950,062 | A * | 9/1999 | Yahata et al. | 399/358 |
| 6,035,168 | A * | 3/2000 | Masuda et al. | 399/254 |
| 6,339,690 | B1 | 1/2002 | Karasawa | |
| 2004/0253022 | A1 * | 12/2004 | Arai et al. | 399/253 |

FOREIGN PATENT DOCUMENTS

| | | |
|---|---|---|
| JP | 10-186991 | 7/1998 |
| JP | 10-293458 | 11/1998 |
| JP | 2001-22181 | 1/2001 |

OTHER PUBLICATIONS

Kiyoshi Chatani et al., "Image Forming Member, Toner Removing Apparatus, Developing Apparatus, and Image Forming Apparatus," Unpublished U.S. Appl. No. 11/785,169, filed Apr. 16, 2007.

* cited by examiner

*Primary Examiner* — David M Gray
*Assistant Examiner* — Roy Yi
(74) *Attorney, Agent, or Firm* — Morgan, Lewis & Bockius LLP

(57) ABSTRACT

A developing device includes (a) a developing member; (b) a developer container; (c) a partition member that partitions an interior of the developer container into a primary chamber and a secondary chamber; and (d) a developer-conveying unit that is disposed in the primary chamber, the developing device defining a collected-toner-receiving port through which a collected toner that is collected from a toner image carrier is received into the developer container; and a migration opening through which a developer held in the primary chamber is migratable to the secondary chamber, the developing device further including (e) a capturing unit that is disposed at the migration opening and captures a foreign material which migrates through the migration opening together with the developer; and (f) a foreign-material-removing unit that is disposed at the developer-conveying unit and moves the foreign material out of the developer container in accordance with the rotation of the developer-conveying.

18 Claims, 15 Drawing Sheets

DEVELOPING DEVICE AND IMAGE-FORMING APPARATUS

CROSS-REFERENCE TO RELATED APPLICATIONS

This application is based on and claims priority under 35 USC 119 from Japanese Patent Application No. 2006-239567 filed on Sep. 4, 2006.

BACKGROUND

The present invention relates to a developing device and an image-forming apparatus.

SUMMARY

According to an aspect of the invention, there is provided a developing device including (a) a developing member that forms a toner image on a surface of a toner image carrier holding the toner image; (b) a developer container that holds a developer including a toner; (c) a partition member that partitions an interior of the developer container into a primary chamber and a secondary chamber; and (d) a developer-conveying unit that is disposed in the primary chamber and rotates so as to convey the developer, the developing device defining a collected-toner-receiving port through which a collected toner that is collected from the toner image carrier is received into the developer container; and a migration opening through which the developer held in the primary chamber is migratable to the secondary chamber, the developing device further including (e) a capturing unit that is disposed at the migration opening and captures a foreign material which migrates through the migration opening together with the developer; and (f) a foreign-material-removing unit that is disposed at the developer-conveying unit and moves the foreign material that is captured by the capturing unit out of the developer container in accordance with the rotation of the developer-conveying unit so as to remove the foreign material.

DETAILED DESCRIPTION

Hereinafter, an example of a configuration of a best mode for carrying out the invention (hereinafter, referred to as an "exemplary embodiment") will be described in detail by reference to the accompanying drawings.

Figure 1:
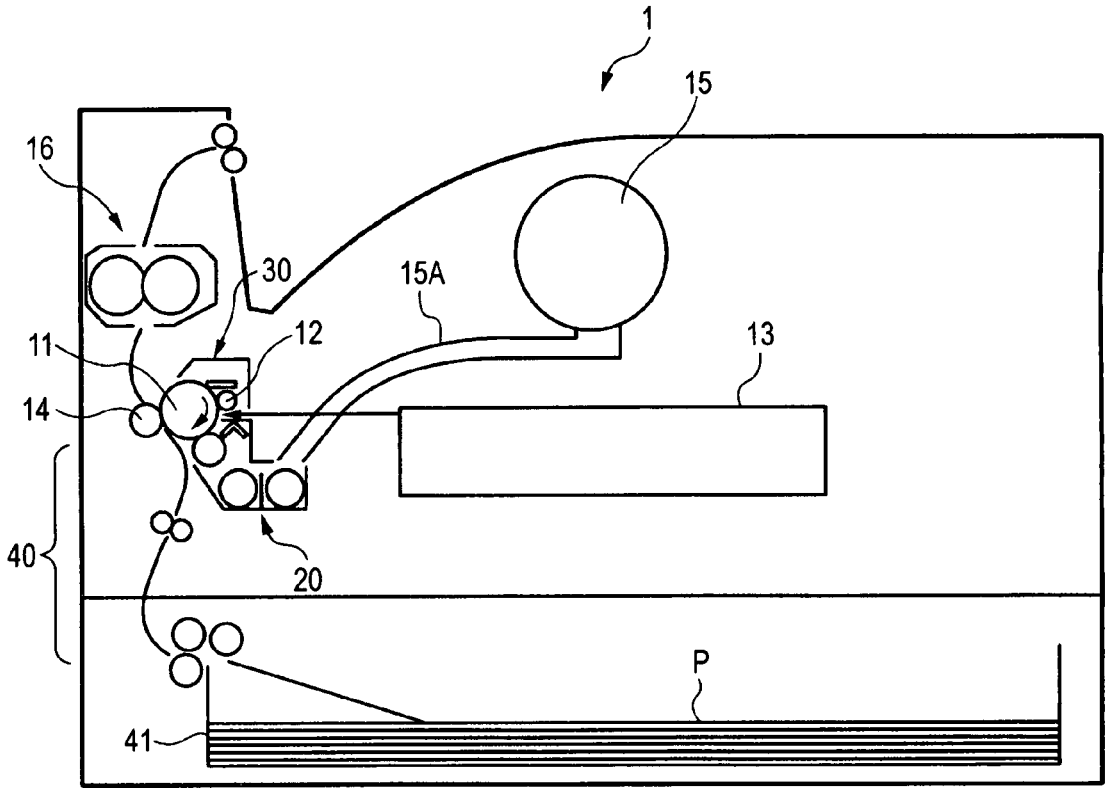
FIG. 1 depicts a schematic diagram as viewed from an operation side which shows an overall configuration of an image-forming apparatus according to an exemplary embodiment of the invention.
Figure 2:
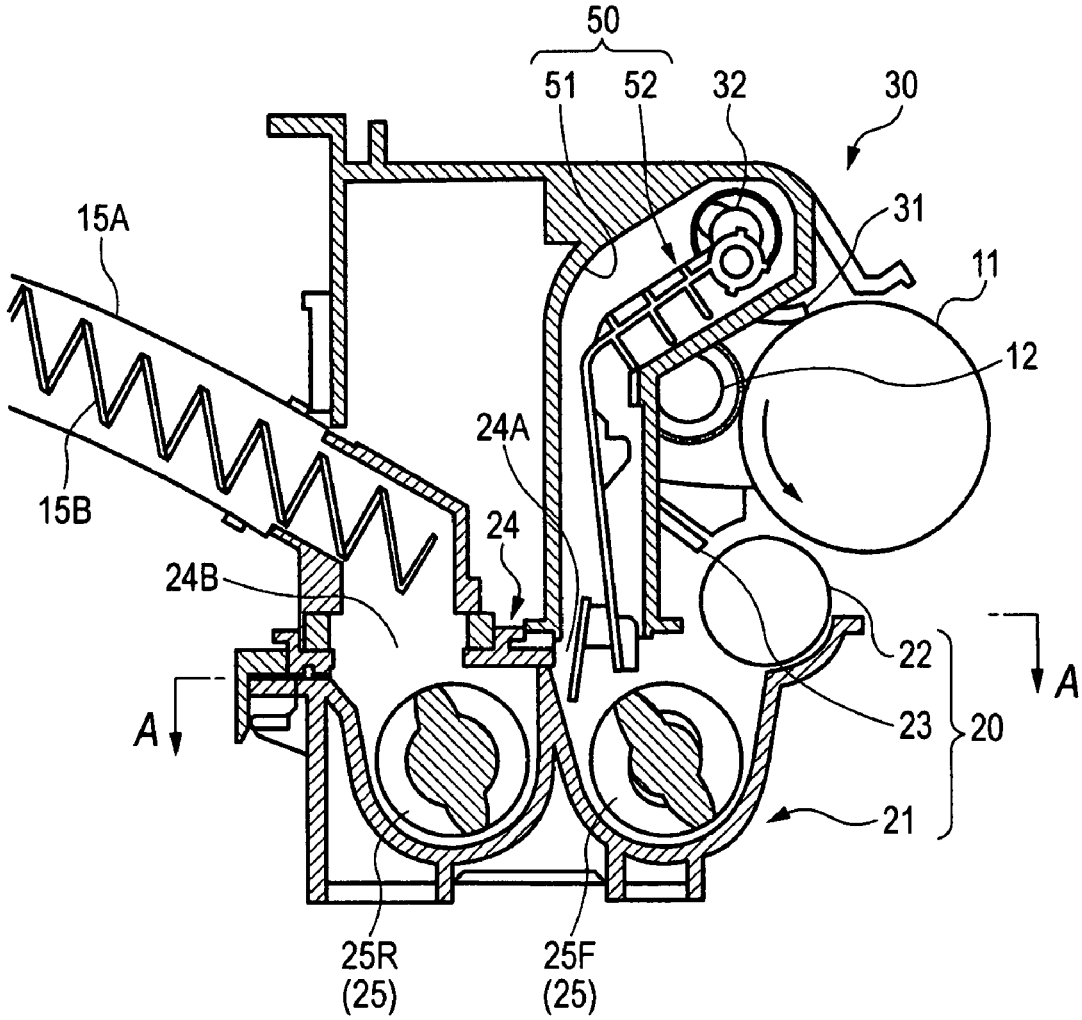
FIG. 2 depicts an enlarged sectional view of an image forming unit of the image-forming apparatus as viewed from a rear side thereof.
Figure 3:
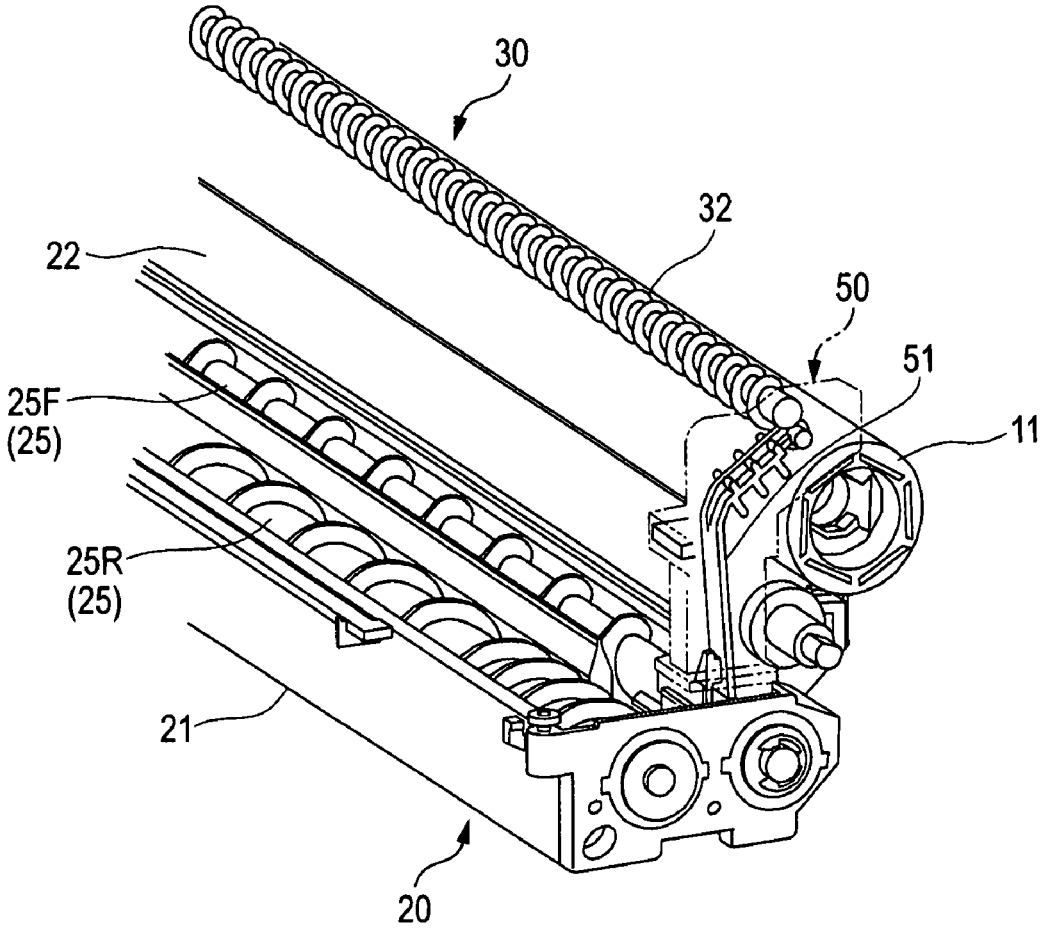
FIG. 3 depicts a perspective view as viewed from the rear side of the apparatus which explains a toner transfer mechanism.
Figure 4:
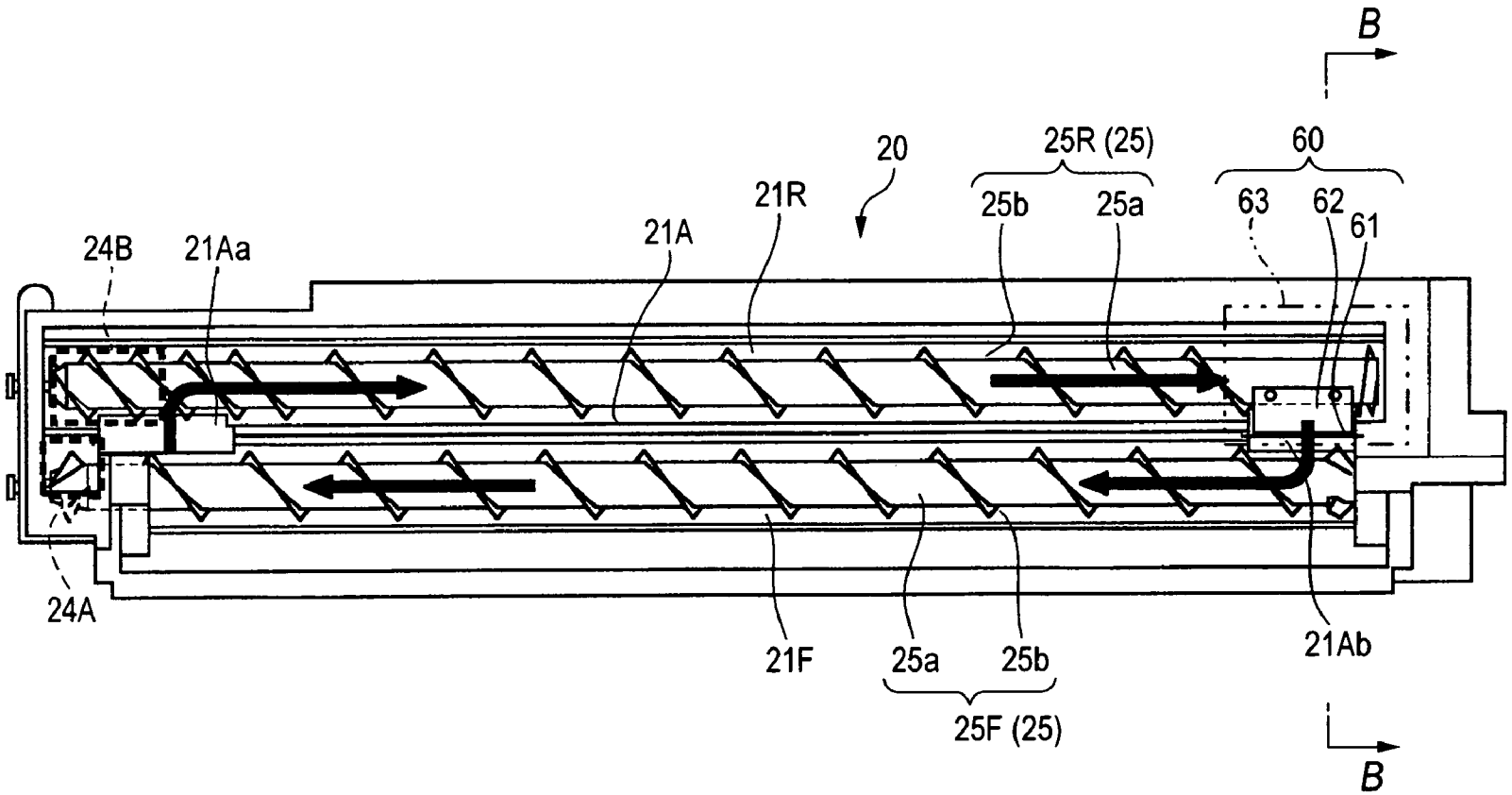
FIG. 4 depicts a plan view of a toner container of a developing device which corresponds to a section taken along the line A-A in FIG. 2.
Figure 5:
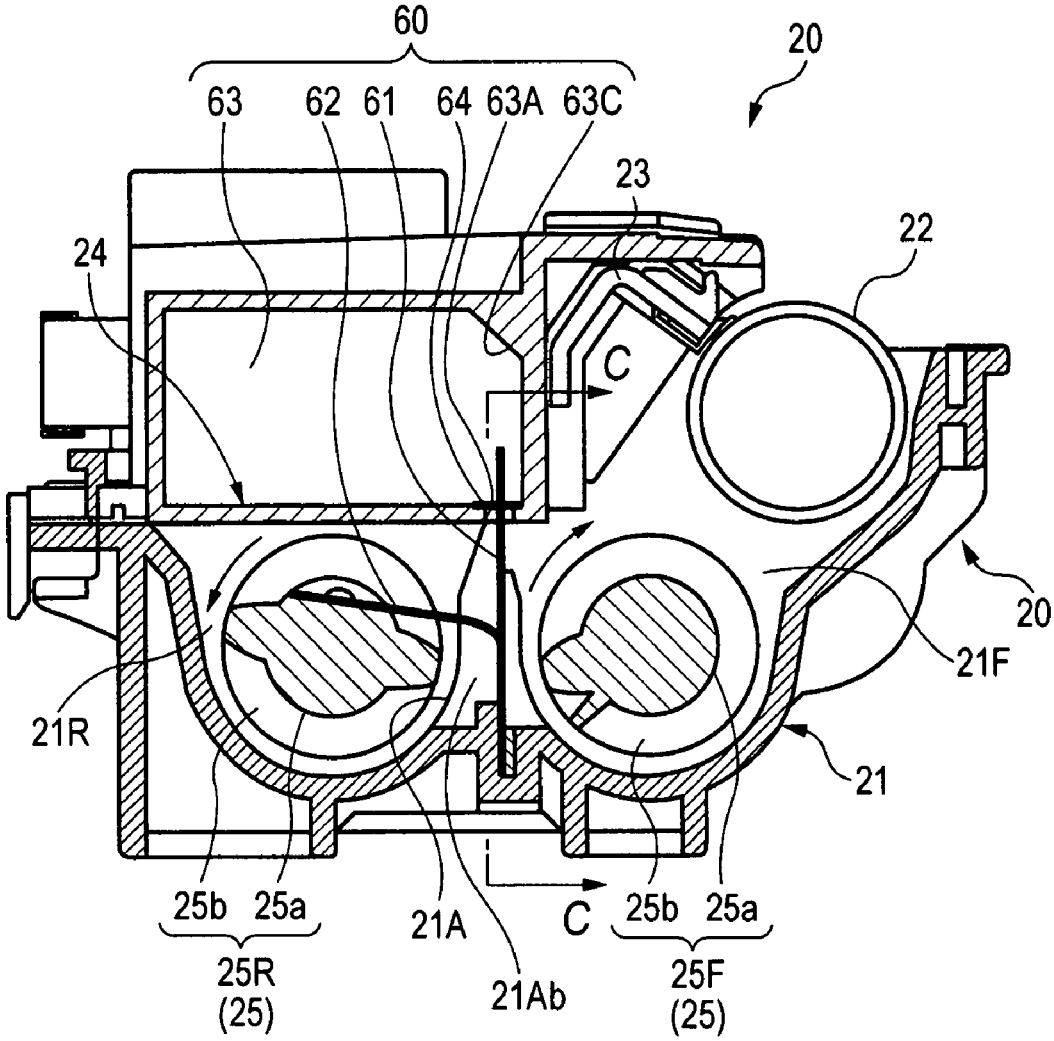
FIG. 5 depicts an enlarged sectional view of the developing device which corresponds to a section taken along the line B-B in FIG. 4.

FIG. 1 is a schematic diagram as seen from an operation side which shows an overall configuration of an image-forming apparatus 1 according to the exemplary embodiment. In addition, FIG. 2 is an enlarged sectional view of an image forming unit of the image-forming apparatus as seen from a rear side thereof. Furthermore, FIG. 3 is a perspective view as seen from the rear side of the apparatus which explains a collected-toner-conveying mechanism 50, FIG. 4 is a plan view of a toner container of a developing device which corresponds to a section taken along the line A-A in FIG. 2, and FIG. 5 is an enlarged sectional view of the developing device 20 which corresponds to a section taken along the line B-B in FIG. 4.

An image-forming apparatus 1 includes functioning units or portions which are involved in implementation of an electrophotography process on the periphery of a photoconductor or light-sensitive material drum 11 which functions as a toner image carrier having a light-sensitive material layer.

Namely, a charging roller 12 for charging the light-sensitive material drum 11 uniformly along a rotational direction of the light-sensitive material drum 11 indicated by an arrow in the figure, a laser scanning unit 13 for scanning the light-sensitive material drum 11 so charged with a laser beam so as to form an electrostatic latent image, a developing device 20 for causing toner to adhere to the electrostatic latent image so formed so as to turn the electrostatic latent image into a toner image, an image transfer roller 14 for transferring the toner image formed on the light-sensitive material drum 11 on to a recording sheet P which is a recording medium, and a cleaning device 30 for removing toner remaining on the light-sensitive material drum 11 after the image transfer is completed are disposed in the image processing apparatus 1.

In addition, the image-forming apparatus 1 includes a detachable toner container (a toner cartridge) for supplying toner to the developing device 20. Furthermore, the image-forming apparatus 1 includes a recording sheets transfer mechanism 40 for transferring recording sheets P held in a sheet tray 41, and a fixing unit 16 for fixing a toner image on a recording sheet P.

The developing device 20 is a two-component developing device which utilizes a developer in which toner and carrier are mixed at a predetermined ratio. Since toner is consumed in conjunction with forming images, toner is designed to be supplied to the developing device 20 from the toner container 15 via a toner supply path 15A. A toner transfer auger 15B (shown in FIG. 2) is provided in an interior of the toner supply path 15A.

In addition, the cleaning device 30 and the developing device 20 are connected by a collected-toner-conveying mechanism 50, whereby toner that is removed and recovered from the light-sensitive material drum 11 by the cleaning device 30 (collected toner) is designed to be returned to the developing device 20 for reuse. These developing device 20, cleaning device 30 and collected-toner-conveying mechanism 50, which is one configuration example of a collected toner transfer unit which connects the developing device 20 and the cleaning device 30, will be described in detail later on.

Then, the image-forming apparatus 1 functions as below to form an image on a recording sheet.

Firstly, an electrostatic latent image matching an image is written by the laser beam unit 13 on to a surface of the light-sensitive material drum 11 which is driven to rotate at a predetermined peripheral speed and is charged to a predetermined potential by the charging roller 12. Following this, the electrostatic latent image so formed is developed (turned into a toner image) by the developing device 20. Furthermore, the toner image is then transferred on to a recording sheet P which is transferred at a speed which is in synchronism with the peripheral speed of the light-sensitive material drum 11 by the recording sheets transfer mechanism 40 by virtue of image transfer bias applied by the image transfer roller 14 in an image transfer position where the light-sensitive material drum 11 confronts the image transfer roller 14. Thereafter, the recording sheet P on to which the toner image has been so transferred is transferred to the fixing unit 16 by the recording sheets transfer mechanism 40, so that the toner image is fixed to the recording sheet P by the fixing unit 16, the recording sheet P being then discharged to outside the apparatus. The cleaning device 30 removes and recovers residual toner remaining on the light-sensitive material drum 11 even after the toner image was transferred on to the recording sheet P. The collected-toner-conveying mechanism 50 returns the collected toner to the developing device 20.

Next, the cleaning device 30, the developing device 20 and the collected-toner-conveying mechanism 50, which transfers toner recovered by the cleaning device 30 to the developing device 20, will be described in detail. Note that it is understood in the following description that a side of the developing device 20 which is near to the light-sensitive material drum 11 is represented as the front, whereas a side which is far from the light-sensitive material drum 11 is represented as the rear.

The cleaning device 30 is situated downstreammost in the electrophotographic devices which are arranged along the rotational direction of the light-sensitive material drum 11, which is indicated by the arrow in FIG. 2, and includes a blade 31 and a cleaner auger 32.

The blade 31 is formed into a plate shape of an elastic material such as a thermoset urethane rubber which has superior mechanical characteristics such as wear resistance, chipping resistance and creep resistance and is provided in such a state that a distal edge thereof is brought into abutment with the light-sensitive material drum 11.

The cleaner auger 32 is provided on an upper side of a proximal end portion of the blade 31 in such a manner as to extend in a longitudinal direction of the blade 31. Then, the cleaner auger 32 is designed to be driven to rotate by a rotational driving mechanism, not shown, so as to transfer collected toner which is removed from the light-sensitive material drum 11 by the blade 31 to the collected-toner-conveying mechanism 50, which will be described later on.

The collected-toner-conveying mechanism 50 is connected to a toner transfer side end portion of the cleaner auger 32.

The collected-toner-conveying mechanism 50 includes a collected toner transfer path 51 which connects the cleaning device 30 with the developing device 20 and a toner transfer lever 52 provided in an interior of the collected toner transfer path 51 and is configured to be located at an end portion on a rear side (a far side in FIG. 1, and a near side in FIG. 2) of the image-forming apparatus 1.

The collected toner transfer lever 52 is connected to the cleaning device 30 at an upper end and to an upper portion of the developing device 20 at a lower end thereof.

The toner transfer lever 52 is mounted at an end portion of the cleaner auger 32 at an end portion thereof eccentrically relative to a rotational center of the cleaner auger 32 in such a manner as to rotate freely about the upper end and is provided in the interior of the collected toner transfer path 51. Then, the toner transfer lever 52 moves vertically in the interior of the collected toner transfer path 51 by virtue of rotation of the cleaner auger 32 and functions to drive and transfer toner so recovered.

Note that the mechanism which transfers toner recovered by the cleaning device 30 to the developing device 20 (the collected toner transfer path 51 and the toner transfer lever 52 in the configuration of this example) is not limited to the configuration that has just been described, and hence, a configuration may be adopted in which toner is transferred using a spiral vane (auger) or a spiral member (a coiled auger).

The developing device 20 includes in a developing housing 21 as a developer container which holds a developer a developing roller 22 which is a developing member, two screw augers 25 (a front auger 25F which lies on a front side, and a rear auger 25R which lies on a rear side) which constitute a developer-conveying unit, and a trimmer 23.

In addition, a developer is circulated and stirred within the developing housing 21 by the two screw augers 25 so that toner and carrier are brought into friction with each other for toner to be charged for adhesion to the developing roller 22. The developing roller 22 is such as to function to transfer the charged toner that adheres thereto by virtue of rotation of a developing sleeve thereof, so as to transfer the toner to a developing area which oppositely faces the light-sensitive material drum 11. Namely, in this exemplary embodiment, the two screw augers 25 are the rotational transfer mechanism and constitute the toner transfer unit.

The trimmer 23 controls the thickness of a toner layer to a predetermined thickness.

The developing housing 21 opens to a side which oppositely faces the light-sensitive material drum 11, and the developing roller 22 is provided in the opening. The screw augers 25 (the front auger 25F, the rear auger 25R) are provided in an interior of the developing housing 21. In addition, the trimmer 23 is provided on an upper side of the developing roller 22.

An upper surface of the developing housing 21 is closed by an upper cover 24. As is indicated by broken lines in FIG. 4, a collected-toner-receiving port 24A and a fresh toner supply port 24B, which functions as a developer-supplying port, are formed to open in such a manner as to be arranged adjacent to each other in a depth direction of the apparatus on a far side of the augers 25. The collected-toner-conveying mechanism 50 (the collected toner transfer path 51) is connected to the collected-toner-receiving port 24A, while the toner supply path 15A from the toner container 15 is connected to the fresh toner supply port 24B.

Although not shown in detail, the developing roller 22 is made up of the developing sleeve to which a developing bias power supply is connected and which is provided rotatably, and a magnet roller which is fixed to an inner side of the developing sleeve and in an interior of which plural magnets are arranged.

The developing housing 21 has a length which can cover longitudinally the whole area of the light-sensitive material drum 11, and the interior thereof is partitioned into two front and rear spaces (a front space 21F which lies on a front side which is near to the light-sensitive material drum 11, a rear space 21R which lies on a rear side which is far from the light-sensitive material drum 11) by a bulkhead 21A which is a partition member erected from a bottom plate to a predetermined height. The screw augers 25 (the front auger 25F, the rear auger 25R) are provided in the front space 21F and the rear space 21R, respectively, in such a manner as to extend in parallel with the developing roller 22.

In addition, communicating portions 21Aa, 21Ab, which function as migration openings where the bulkhead 21A is not erected within a predetermined range, are formed at longitudinal (a direction parallel to an axial direction of the light-sensitive material drum 11) end portions of the developing housing 21, and the front space 21F and the rear space 21R are designed to communicate with each other via these communicating portions 21Aa, 21Ab.

The screw augers 25 (the front auger 25F, the rear auger 25R), which are provided in the interior of the developing housing 21, are made to be driven to rotate by a driving unit such as a motor or the like, which is not shown. In this exemplary embodiment, in FIG. 5, as is indicated by an arrow, the front auger 25F rotates clockwise in the figure, while the rear auger 25R rotates counterclockwise in the figure.

Feeding vanes 25*b* are formed spirally on circumferences of shafts 25*a* of the screw augers 25, and developer lying on the peripheries of the screw augers 25 is transferred by the feeding vanes 25*b* as they rotate.

The rotational directions of the screw augers 25 and the spiral directions of the feeding vanes 25*b* are set in such a way that developer is transferred in directions indicated by arrows in FIG. 4. Namely, the front auger 25F, which lies on the front side which is near to the developing roller 22, is designed to transfer developer from right to left within the front space 21F, while the rear auger 25R is designed to transfer developer from left to right within the rear space 21R as seen in FIG. 4. Since the front space 21F and the rear space 21R are made to communicate with each other at the communicating portions 21Aa, 21Ab which are provided at the both end portions of the screw augers 25, developer migrates from the front space 21F to the rear space 21R and from the rear space 21R to the front space 21F via the communicating portions 21Aa, 21Ab. Namely, developer circulates in the interior of the developing housing 21 in the clockwise direction as viewed in FIG. 4.

In this way, by circulating developer in the interior of the developing housing 21 by the two screw augers 25, developer is stirred and toner is charged through friction with carrier.

The collected-toner-receiving port 24A, to which the collected-toner-conveying mechanism 50 (the collected toner transfer path 51) is connected, is set at a downstreammost location (on an upper side of a most downstreammost end portion of the front auger 25F) in a traveling direction of developer in the front space 21F. In addition, the fresh toner supply port 24B, to which the toner supply path 15A is connected, is set at an upstreammost location (an upper side of an upstreammost end portion of the rear auger 25R) in the traveling direction of developer in the rear space 21R.

A vane, whose spiral direction is opposite, is formed at a location of the front auger 25F which oppositely faces the collected-toner-receiving port 24A, whereby collected toner which is supplied from the collected toner transfer path 51 is transferred in an opposite direction to the circulating direction of developer in the interior of the front space 21F. Consequently, collected toner which is supplied from the collected toner transfer path 51 is designed to be joined to the circulating developer before the communicating portion 21Aa.

Here, a foreign material capture and removal mechanism 60, which functions as the foreign-material-removing unit, is provided at the communicating portion 21Ab where developer migrates from the rear space 21R to the front space 21F. Namely, in this configuration example, the rear space 21R constitutes the primary chamber of the invention, the rear auger 25R constitutes the developer-conveying units of the invention, and the communicating portion 21Ab constitutes the migration opening of the invention.

Next, referring to FIGS. 4, 5 and 6 to 8, the foreign material capture and removal mechanism 60 will be described.

Figure 6:
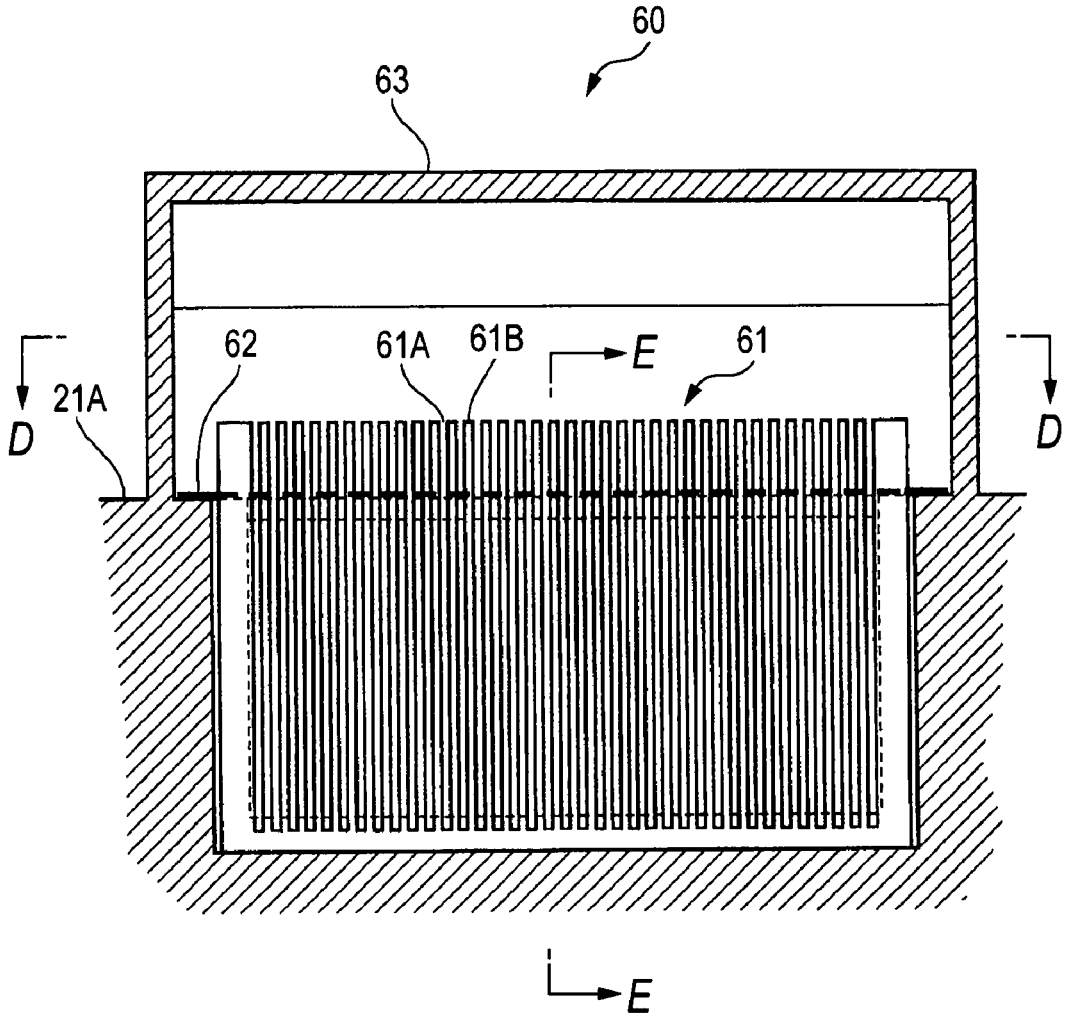
FIG. 6 depicts a sectional view taken along the line C-C in FIG. 5.
Figure 7:
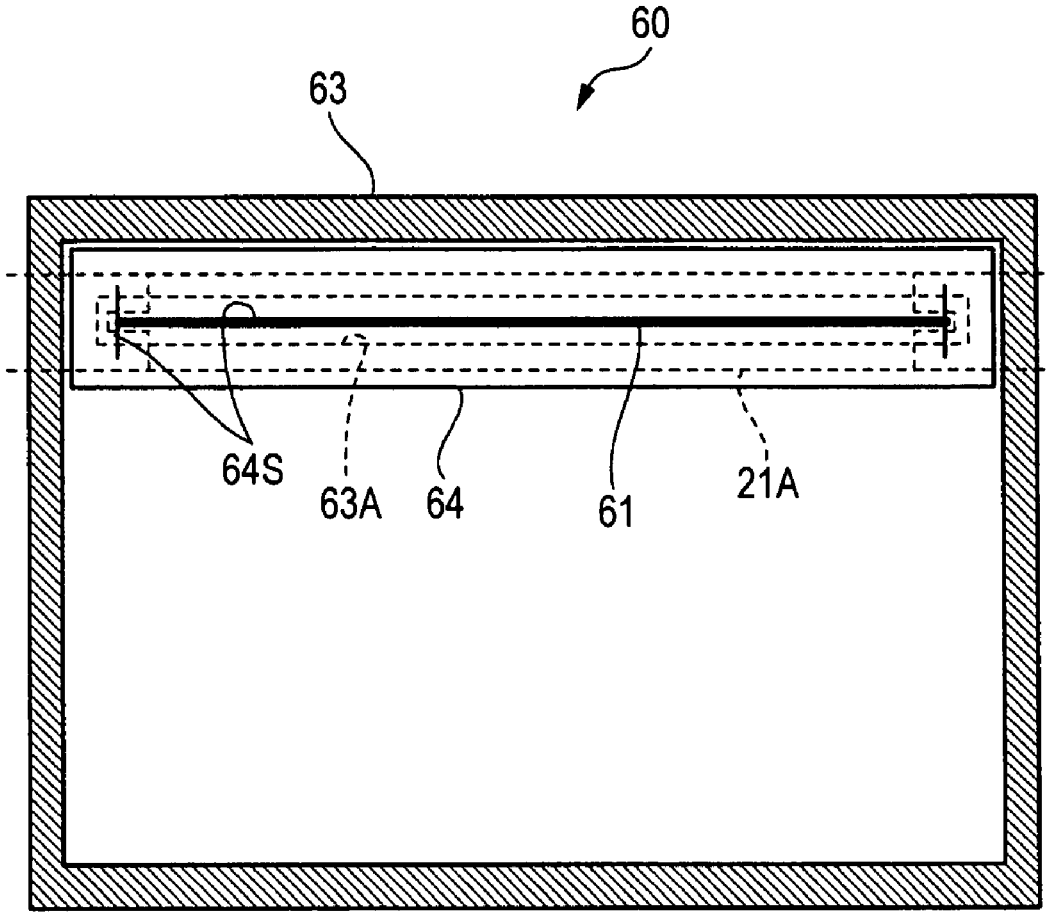
FIG. 7 a sectional view taken along the line D-D in FIG. 6.
Figure 8:
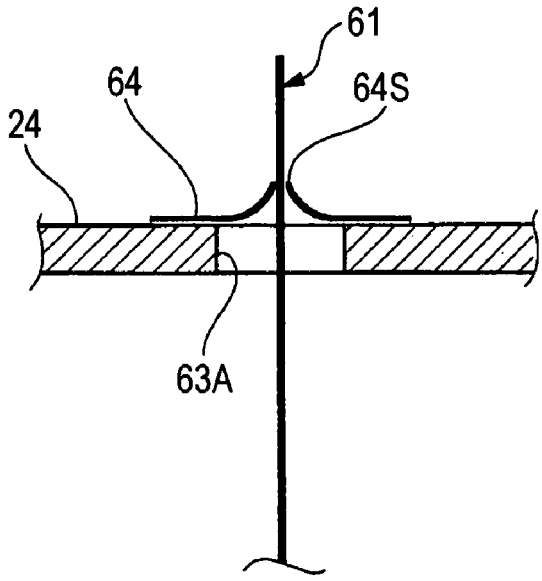
FIG. 8 depicts diagrams showing a non-return mechanism, in which (a) is a sectional view taken along the line E-E in FIG. 6, and (b) is a diagram which explains the function thereof.
Figure 8:
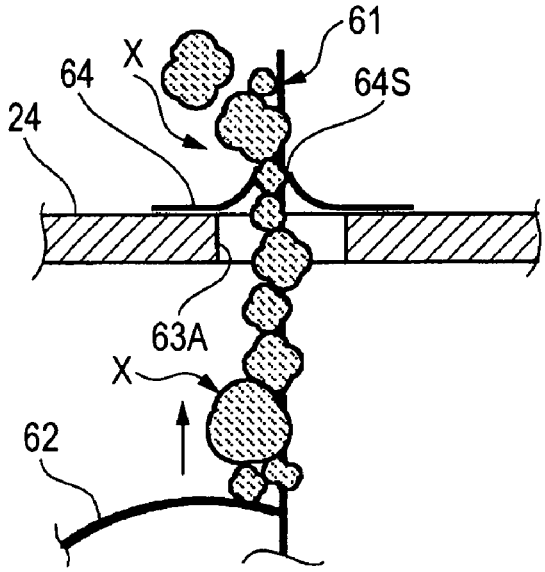

FIG. 6 is a sectional view taken along the line C-C in FIG. 5, and FIG. 7 is a sectional view taken along the line D-D in FIG. 6. FIG. 8 shows a non-return mechanism, wherein FIG. 8(*a*) is a sectional view taken along the line E-E in FIG. 6 and FIG. 8(*b*) is a diagram illustrating the function of the non-return mechanism.

The foreign material capture and removal mechanism 60 includes a filter 61 which functions as a capturing unit provided in such a manner as to close the communicating portion 21Ab, a wiping sheet 62 which functions as a movement controller which controls the removal of captured foreign materials by wiping the filter 61, and a foreign material holding container 63 which functions as a foreign material container which is made on an upper side of the wiping sheet 62.

The filter 61 is made up of a thin plate which is formed into a rectangular shape which can close the communicating portion 21Ab. Vertically elongated slits 61A are formed in parallel at predetermined intervals in a horizontal direction on the filter 61 at locations except for a lower edge and left and right trimmed frame portions. The slits 61A are made to open upwards and unopened portions between the slits 61A constitute linear capture portions 61B which function as a capturing member. Namely, the filter 61 is formed into a so-called comb-like shape.

The width (opening width) of the slit 61A is preferably in the range of, for example, 0.1 to 1.5 mm, and the width of the linear capture portion 61B is preferably on the order of 0.1 mm. However, they are set in consideration of numerical aperture in relation to the circulation volume of developer and so that the linear capture portion 61B can have such rigidity as to maintain its shape. The filter 61 like this can be formed by opening to form slits 61A on a plate of stainless steel alloy or the like which has a predetermined thickness (for example, 0.1 mm) through etching or the like. The thickness of the filter 61 is set to have such rigidity as not to cause any failure such as deformation or fall even through wiped by the wiping sheet 62, which will be described later on.

Then, the filter 61 is fitted in a mounting groove formed on the circumference of the communicating portion 21Ab and is further fixed thereto with an adhesive as required, whereby the filter 61 is provided in such a manner as to cover the communicating portion 21Ab. An upper edge of the filter 61 passes through the upper cover 24 to reach an interior of the foreign material holding container 63, which will be described later on, whereby developer is allowed to communicate through the filter 61 (or pass through the slits 61A) so as to migrate from the rear space 21R to the front space 21F. In the event that the filter 61 is mounted only through fitting, even though the service lives of the developing device 20 and the filter 61 are different, the replacement of filters 61 is enabled.

Note that the material and fabrication method of the filter 61 are not limited to the configurations that have been described above and hence can be modified appropriately. In addition, the filter 61 does not have to be formed as an integral part but may be made up of plural rod-like members which are provided in parallel at predetermined intervals so as to function as a capturing unit. Furthermore, the mounting construction of the filter 61 may be modified appropriately, so that, for example, the filter 61 may be bonded to a wall surface of the bulkhead 21A.

The foreign material holding container 63 is defined as a substantially rectangular parallelepiped container of a predetermined capacity by wall surfaces and a ceiling surface on the upper cover 24 on an upper side of the rear auger 25R in a position which oppositely faces the location where the filter 61 is provided (the communicating portion 21Ab).

An opening 63A is formed in a bottom surface (that is, the upper cover 24) of the foreign material holding container 63 in a position which oppositely faces the filter 61 in such a manner as to allow the filter 61 to pass therethrough.

As has been described above, since the foreign material holding container 63 is positioned on the upper side of the rear auger 25R, the opening 63A is positioned in the vicinity of a front wall surface of the foreign material holding container 63. An inclined surface 63C is formed in a corner portion between the ceiling surface above the opening 63A and the wall surface.

In addition, as is shown in FIG. 7, a non-return member 64, which makes up a reverse-flow-restricting member, is provided at the opening 63A, and the upper edge of the filter 61 passes through the non-return member 64 to protrude a predetermined distance into the interior of the foreign material holding container 63.

As is shown in FIGS. 7 and 8(*a*), the non-return member 64 is formed of a thin PET resin into something like a sheet which is sized to cover the opening 63A and is made to easily be deformed in an elastic fashion. A cut 64S is formed in a center of the non-return member 64 in such a manner as to allow the filter 61 to pass therethrough, and the non-return member 64 is fixed to an upper surface of the upper cover 24 in such a manner as to close the opening 63A using an adhesive or the like.

In addition, cuts 64S are made in the longitudinal or depth direction of the apparatus at both ends of the lateral rectilinear cut having the length matching the length of the filter 61 in such a manner as to intersect the longitudinal rectilinear cut at right angles.

Then, the filter 61 is inserted through the non-return member 64 mounted on the opening 63A from therebelow in such a manner as to bend (elastically deform) the non-return member 64 to an interior side of the foreign material holding container 63.

The non-return member 64 permits the filter 61 to pass through the cut 64S by being elastically deformed and bent at portions thereof which lie at both the ends of the cut 64S, and edges of the non-return member 64 are brought into contact with plate-like surfaces of the filter 61 by virtue of elastic restoring force thereof.

The wiping sheet 62 is an elastically deformable thin rectangular plate having a width matching that of the filter 61 and is made up of a resin sheet of, for example, a PET resin or the like. In addition, the wiping sheet 62 is fixed to the shaft 25*a* of the rear auger 25R along one side thereof through thermal welding or the like. The location where the wiping sheet 62 is provided and length thereof are set such that a distal end portion of the wiping sheet 62 is brought into contact with the filter by virtue of rotation of the rear auger 25R in such a manner as to wipe the filter 61 from bottom to tope.

Namely, the wiping sheet 62 is made such that the distal end thereof is brought into contact with a substantially lower end portion of the filter 61 when it rotates, the interference amount of the wiping sheet 62 with the filter then increases as it rotates further to become maximum at a substantially center of the filter 61 in its height direction, and with the interference amount gradually decreasing, the wiping sheet 62 reaches an upper end portion of the filter 61.

Note that a rotational shaft (that is the rotational shaft of the rear auger 25R) of the wiping sheet 62 is horizontal and intersects the slits 61A of the filter 61 at right angles, whereby the wiping sheet 62 is made to move in the direction of the slits 61A (in a direction of extension of the linear capture portions 61B).

In the foreign material capture and removal mechanism 60 that is configured as has been described above, the filter 61 captures foreign materials such as paper dust which are mixed into developer which circulates (enters from the rear space 21R to the front surface 21F) in the interior of the developing housing 21, the wiping sheet 62 then removes the foreign materials captured by the filter 61 along the filter 61 (in the direction of extension of the linear capture portions 61B) to an upper side thereof, and the wiping sheet 62 continues to remove the foreign materials so as to pushed then into the interior of the foreign material holding container for accumulation.

Namely, in the filter 61 placed in the communicating portion 21Ab, when developer passes through the slits 61A on the filter 61, foreign materials mixed into developer are caught and captured at the linear capture portions 61B between the slits 61A. The wiping sheet 62 removes the foreign materials captured by the filter 61 along the slits 61A (the linear capture portions 61B) to the upper side of the filter 61, so as to prevent the disturbance of passage of developer by foreign materials.

Since the wiping sheet 62 removes foreign materials to the upper side of the filter 61 sequentially from the bottom or a lower portion thereof, as is shown in FIG. 8(*b*), upper foreign materials X are pushed upwards by lower foreign materials X, and when foreign materials X so pushed upwards reach the position where the non-return member 64 is provided, the foreign materials X intrude into the interior of the foreign material holding container 63 while elastically deforming the non-return member 64. The non-return member 64 is bent to the interior side of the foreign material holding container 63 and prevents the foreign materials X that have once entered the interior of the foreign material holding container 63 from returning to outside the foreign material holding container 63. In addition, mass of foreign materials which grows to an upper side of the foreign material holding container 63 therein is led along the inclined surface 63*c* formed in the corner portion between the ceiling surface and the wall surface to a holding space which spreads to the rear (leftwards as seen in FIG. 5), so as to be held therein efficiently.

In this configuration, foreign materials captured by the filter 61 are removed into the foreign material holding container 63 by the wiping sheet 62 so as to be accumulated in the interior of the foreign material holding container 63, whereby the filter 61 allows developer to continue to pass therethrough without being clogged by foreign materials, so that foreign materials can be filtered and captured by the filter 61.

Note that in this exemplary embodiment, the foreign material holding container 63 is configured to be integrated into the developing device 20. Because of this, the foreign material holding container 63 needs to have a capacity to hold foreign materials that are accumulated until the end of the service life of the developing device 20. However, the foreign material holding container 63 may be configured as a separate element which can detachably be mounted on the developing device 20, so that foreign materials accumulated can be disposed of. As this occurs, the foreign material holding container 63 can be constructed compact.

Here, in the configuration example that has been described heretofore, the foreign material capture and removal mechanism 60 is provided in the communicating portion 21Ab where developer migrates from the rear space 21R to the front space 21F, so that the filter 61 provided in the communicating portion 21Ab is made to be wiped from the rear space 21R side which is an upstream side in the migrating direction of developer by the wiping sheet 62. However, the position where the foreign material capture and removal mechanism 60 is not limited thereto.

Figure 9:
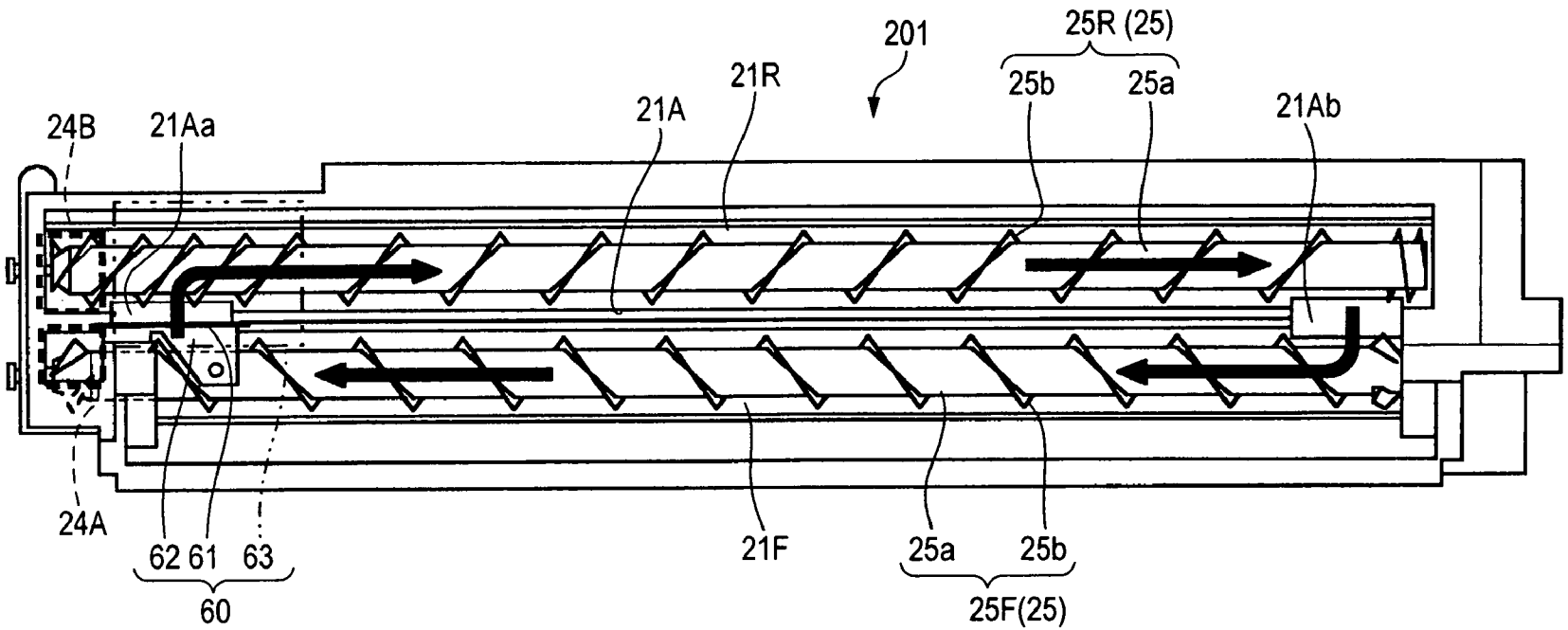
FIG. 9 depicts a plan view of a toner container of a developing device which is different in a position where a foreign material capture and removal mechanism is provided.
Figure 10:
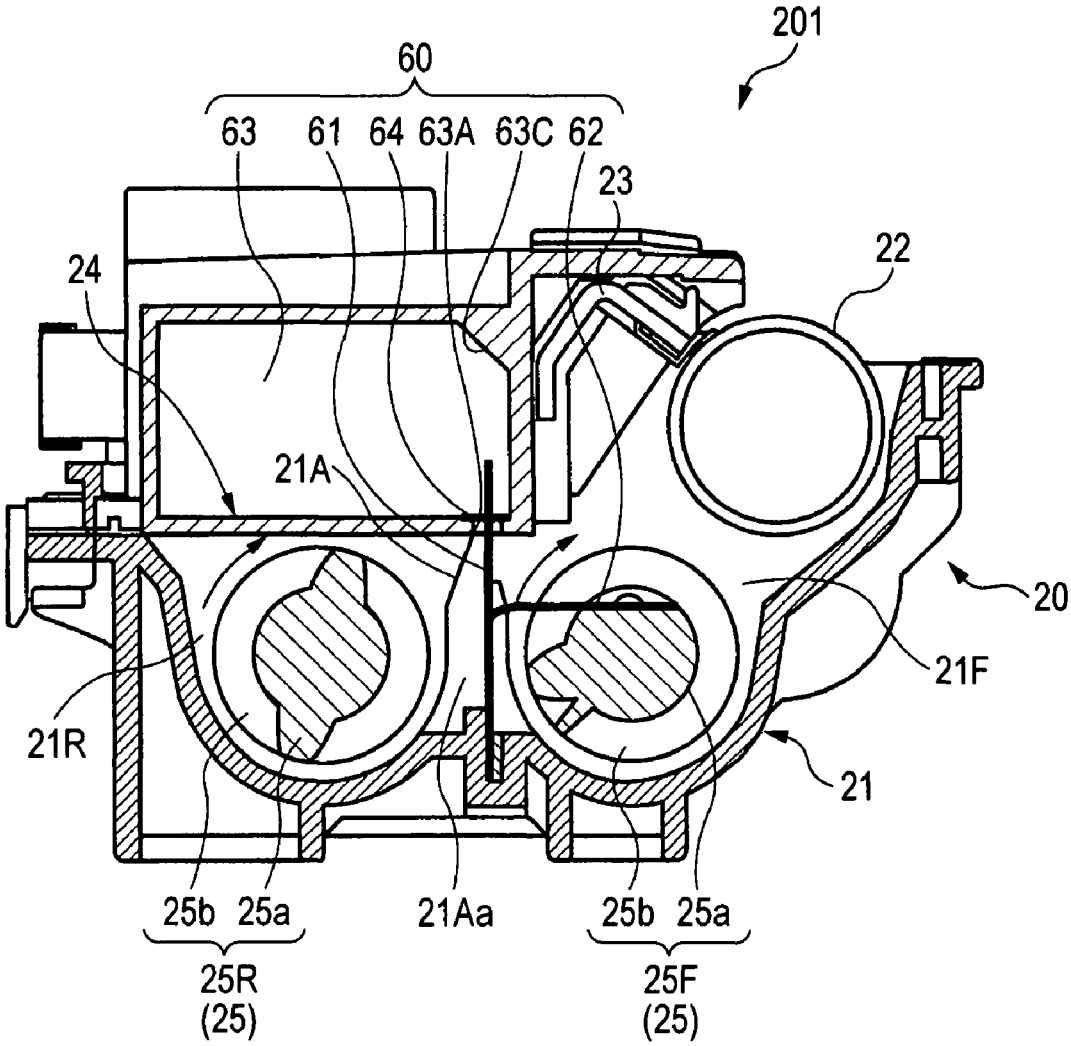
FIG. 10 depicts a sectional view of FIG. 9.

FIG. 9 is a plan view of a toner container of a developing device 201 which is different from the developing device 20 in the position where the foreign material capture and removal mechanism 60 is dispose, and FIG. 10 is a sectional view thereof. Note that in the figures, like reference numerals are given to portions or units which function likely to those described in the above configuration example, so that the description thereof will be omitted.

In the developing device 201 shown in FIGS. 9 to 10, a foreign material capture and removal mechanism 60 is provided in a communicating portion 21Aa where developer migrates from a front space 21F to a rear space 21R. Namely, this configuration example is such that the front space 21F constitutes the primary chamber of the invention, a front auger 25F constitutes the developer-conveying unit of the invention, and the communicating portion 21Aa constitutes the migration opening.

In addition, a wiping sheet 62 is provided on the front auger 25F, and it is designed that as it rotates, a distal end portion thereof wipes a filter 61 from bottom to top.

Note that in this configuration example, in FIG. 10, the front auger 25F and a rear auger 25R are both made to rotate in a clockwise direction as viewed in the figure.

In this configuration, the foreign material capture and removal mechanism 60 is provided in the communicating portion 21Aa which is just downstream of a location (a collected-toner-receiving port 24A) where collected toner is supplied by a collected-toner-conveying mechanism 50, and consequently, collected toner is made to be joined to circulating developer to pass through the foreign material capture and removal mechanism 60 without any delay. Because of this, foreign materials such as paper dust which are mixed into collected toner can be captured and removed efficiently by the foreign material capture and removal mechanism 60.

Figure 11:
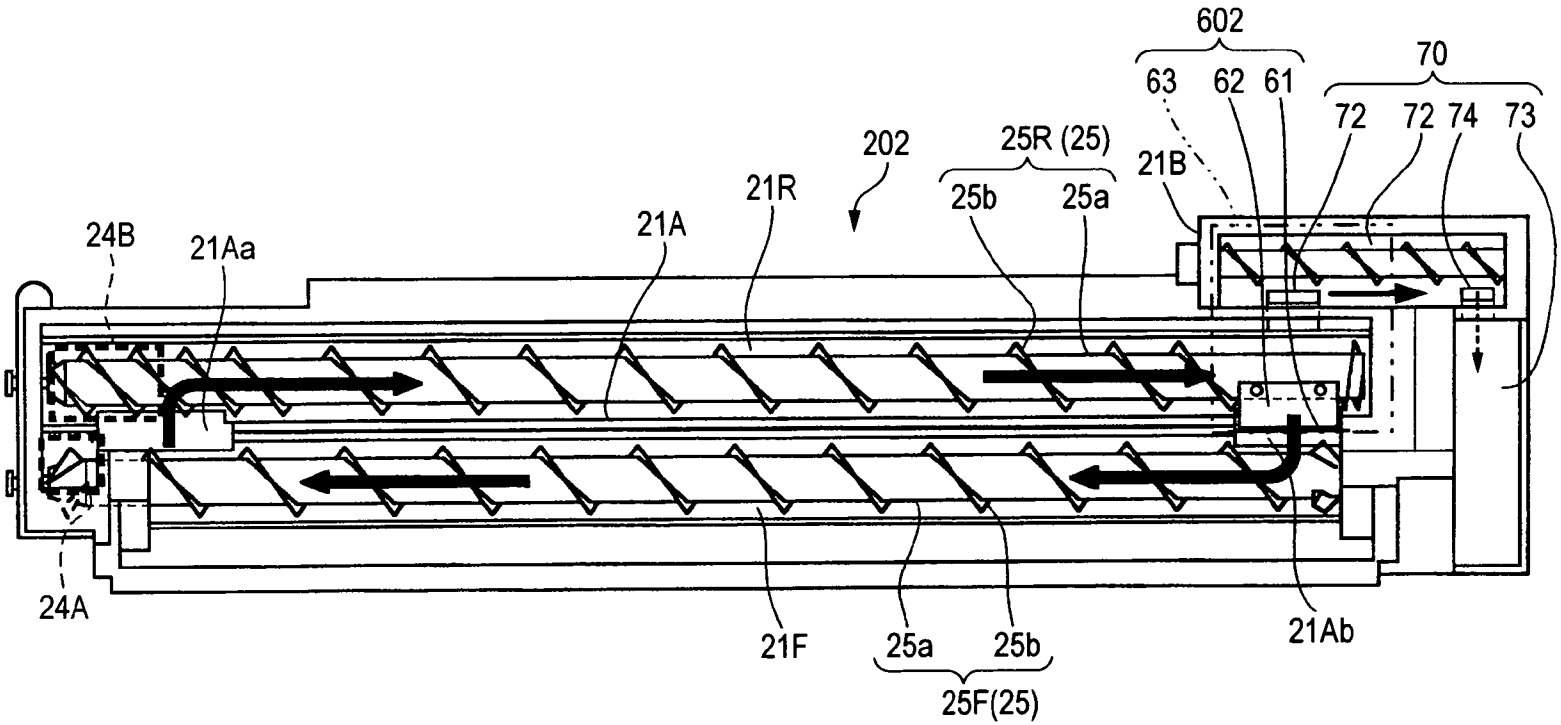
FIG. 11 depicts a plan view of a toner container of a developing device which is configured differently.
Figure 12:
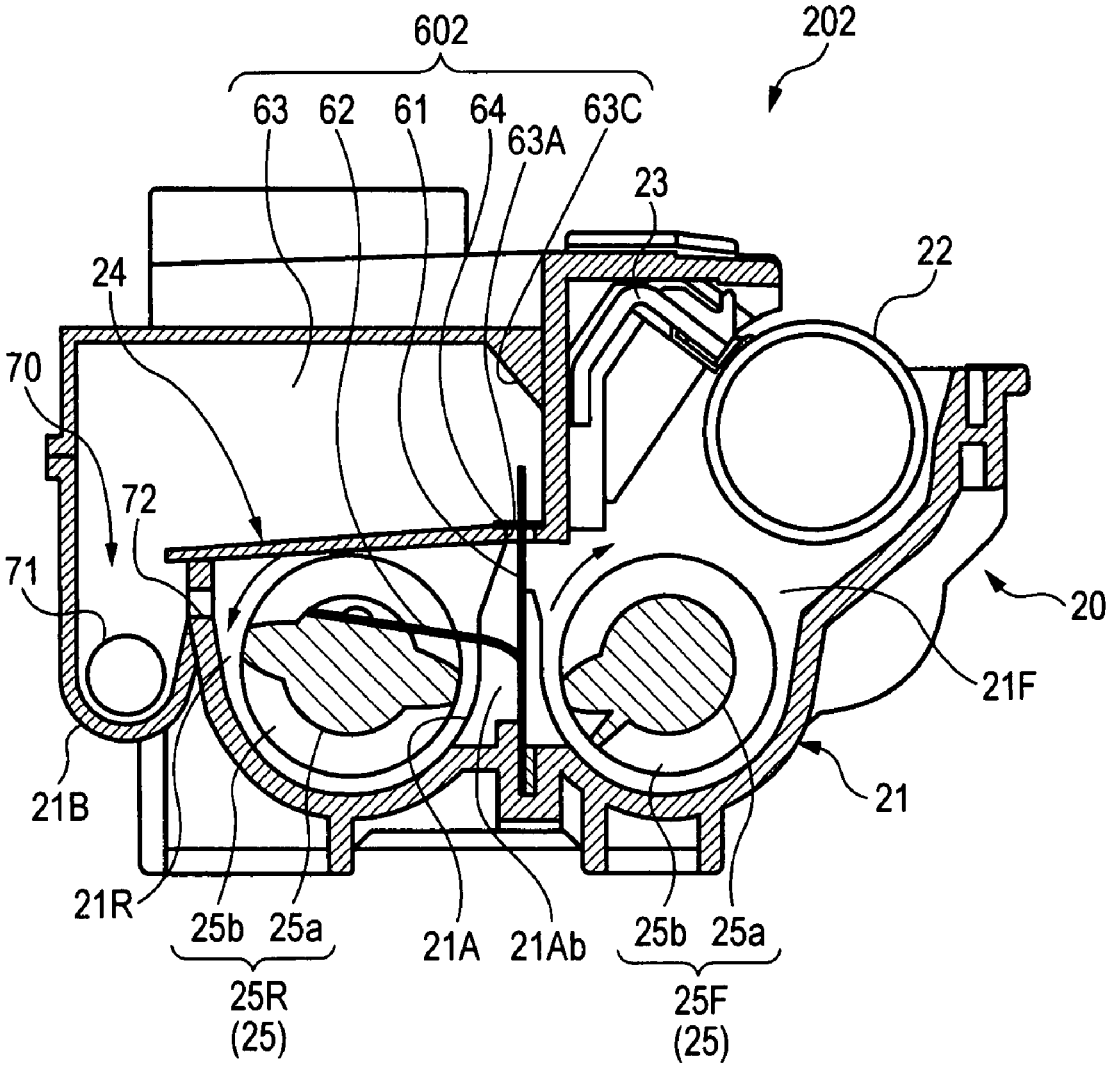
FIG. 12 depicts a sectional view of FIG. 11.
Figure 13:
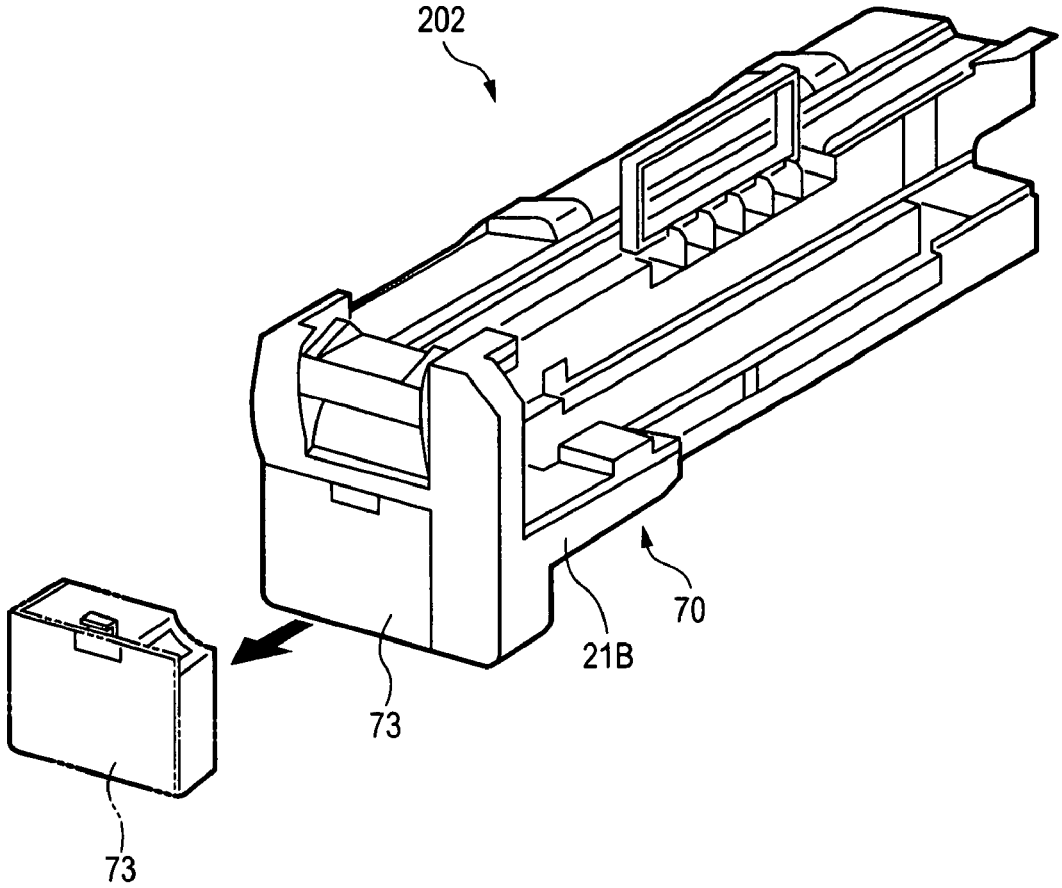
FIG. 13 depicts a perspective view showing an external appearance thereof.

FIGS. 11 to 13 show a developing device 202 which includes a foreign material capture and removal mechanism 602 which is configured differently.

FIG. 11 is a plan view of a toner container of the developing device 202, and FIG. 12 is a sectional view thereof. In addition, FIG. 13 is a perspective view thereof. In the figures, like reference numerals are given to portions or units which function likely to those described in the above configuration example, so that the description thereof will be omitted.

In the developing device 202 shown in FIGS. 11 to 12, a mixture in which a predetermined amount of carriers is made to be mixed into toner is supplied to a fresh toner supply port 24B. In addition, a discharge mechanism 70 for developer is provided as the discharging unit, whereby the discharge mechanism 70 is designed to discharge residual developer (waste developer) from a developing housing 21, whereby deteriorated carriers are made to be replaced in a slight amount at a time with fresh carriers, so as to suppress deterioration in charging capability of developer.

In the developing device 202, developer circulates in an interior of the developing housing 21 in a clockwise direction as viewed in FIG. 11 by screw augers 25 (a front auger 25F, a rear auger 25R).

The discharge mechanism 70 is provided downstreammost in a migrating direction of developer which migrates in a rear space 21R by the rear auger 25R. In addition, the foreign material capture and removal mechanism 602 is provided in a communicating portion 21Ab where developer migrates from the rear space 21R to a front space 21F. Namely, the discharge mechanism 70 and the foreign material capture and removal mechanism 602 are provided at the same end portion of the developing device 202. This configuration example is such that the rear space 21R constitutes the primary chamber of the invention, the rear auger 25R constitutes the developer-conveying unit of the invention, and the communicating portion 21Ab constitutes the migration opening in the invention.

The discharge mechanism 70 includes a discharge auger 71 which is provided in an interior of a discharge housing 21B which is provided on a rear side of the developing housing 21 (an opposite side to a side where a developing roller 22 is provided) in such a manner as to protrude therefrom and a recovering box 73 for holding waste developer which is transferred thereto by the discharge auger 71.

The rear space 21R of the developing housing 21 and the discharge housing 21B are made to communicate with each other by a transfer path 74.

A lower edge of a discharge port 72 is set to a specified level for developer within the developing housing 21, developer exceeding the specified level (waste developer) is made to fall (be discharged) from the discharge port 72 into the discharge housing 21B.

The discharge auger 71 is driven to rotate by a driving unit, not shown, which also drives to rotate the screw augers 25 so as to transfer waste developer discharged from the discharge port 72 into the discharge housing 21B towards the transfer path 74 as indicated by arrows in FIG. 11 to thereby be held in the recovering box 73 via the transfer path 74.

The recovering box 73 is something like a container of a predetermined capacity and is detachably mounted on an end portion of the developing device 202 as is shown in FIG. 13.

The foreign material capture and removal mechanism 602 includes a foreign material holding container 63 which is formed on an upper side of a filter 61 which is provided in the communicating portion 21Ab.

A rear end of an upper cover 24 which constitutes a lower surface of the foreign material holding container 63 does not reach a rear wall surface of the foreign material holding container 63 which coincides in position with a rear wall surface of the discharge housing 21B, and the foreign material holding container 63 and the discharge housing 21B are made to communicate with each other in a position lying further rearwards than a rear end edge of the upper cover 24.

In addition, the upper cover 24, which constitutes the lower surface of the foreign material holding container 63, is formed to be inclined at a predetermined angle in such a manner that a rear side thereof becomes lower.

In the foreign material capture and removal mechanism 602 that is configured as has been described above, the filter 61 captures foreign materials such as paper dust which are mixed into developer which circulates in the interior of the developer housing 21, a wiping sheet 62 removes the foreign materials captured by the filter 61 along the filter 61 to an upper side thereof and pushes them into the foreign material holding container 63. The foreign materials so pushed into the interior of the foreign material holding container 63 are caused to move rearwards along the inclination of the upper cover 24 as the foreign materials accumulates to thereby reach the discharge mechanism 70, whereupon the foreign materials are discharged into the recovering box 73 together with waste developer by the discharge mechanism 70. The foreign materials recovered in the recovering box 73 are disposed of together with waste developer when the recovering box 73 becomes full thereof.

Namely, in this configuration, the discharge mechanism 70 for discharging waste developer is made to double as a disposing unit for disposing foreign materials.

Figure 14:
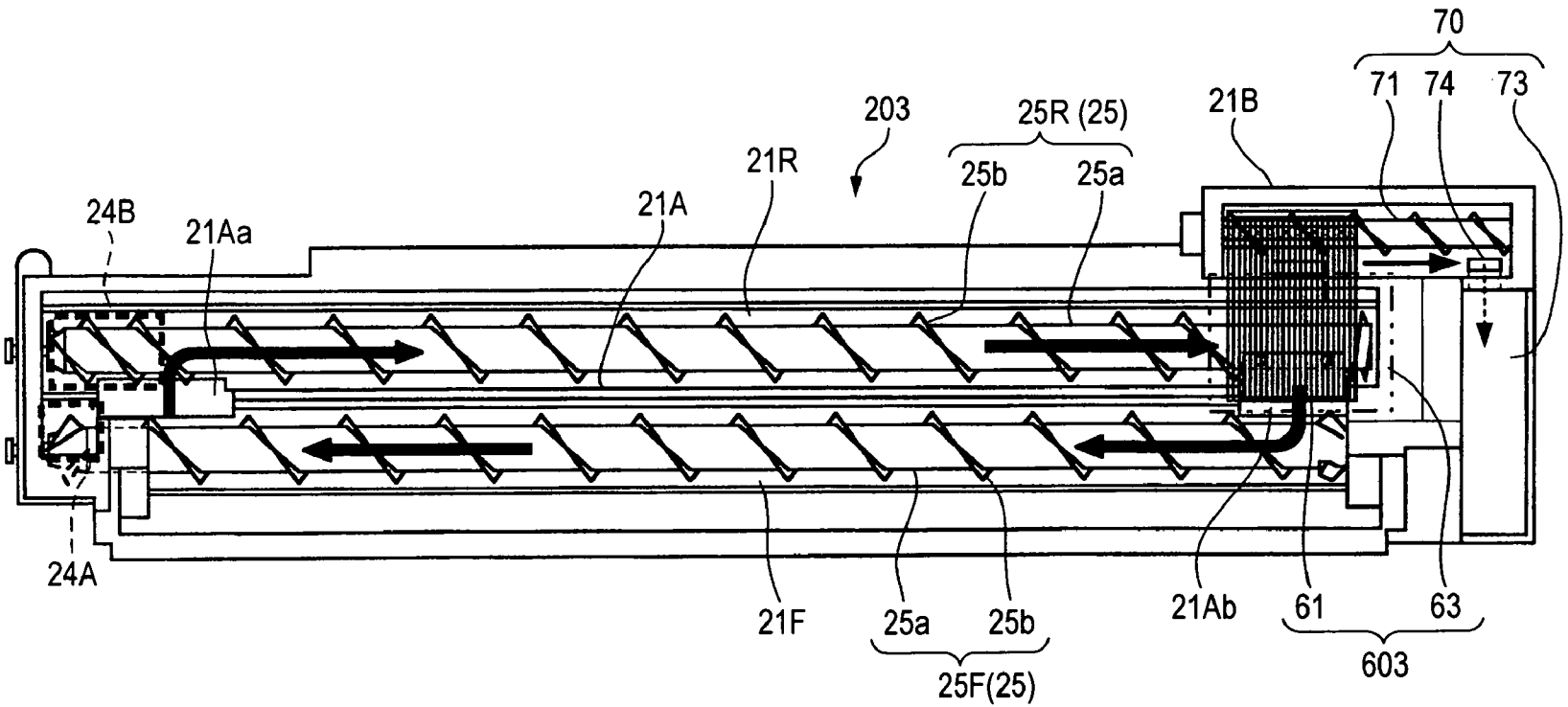
FIG. 14 depicts a plan view of a toner container of a developing device which is configured differently.
Figure 15:
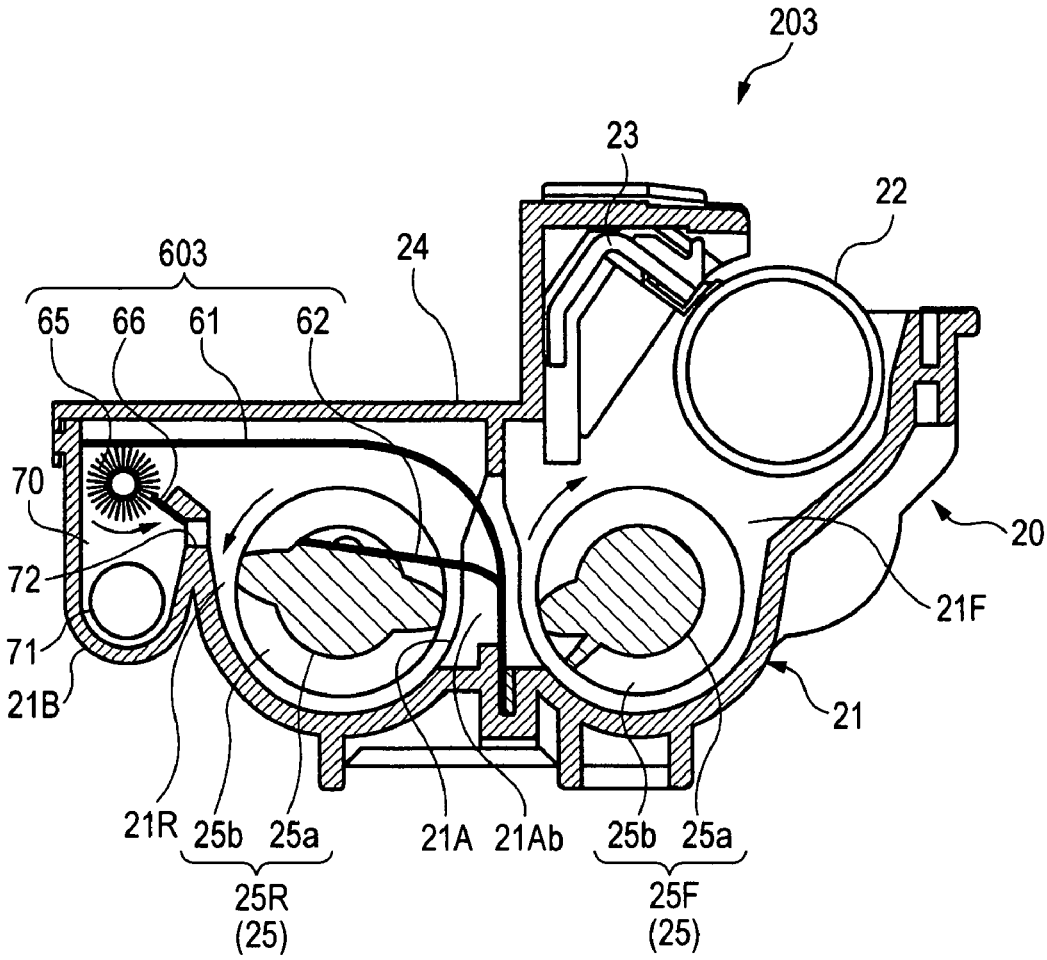
FIG. 15 depicts a sectional view of FIG. 14, wherein 1 denotes an image-forming apparatus; 11 denotes a light-sensitive material drum (toner image carrier); 20, 201, 202 and 203 denote a developing device; 21 denotes a developing housing (developer container); 21A denotes a bulkhead (partition member); 21Aa and 21Ab denotes a communicating portion (migration opening); 21F denotes a front space (primary chamber); 21R denotes a rear space (primary chamber); 22 denotes a developing roller (developing member); 24A denotes a collected-toner-receiving port; 24B denotes a fresh toner supply port (developer-supplying port); 25F denotes a front auger (developer-conveying unit); 25R denotes a rear auger (developer-conveying unit); 30 denotes a cleaning device; 50 denotes a collected-toner-conveying mechanism; 60, 602 and 603 denote a foreign material capture and removal mechanism (foreign-material-removing unit); 61 denotes a filter (capturing unit); 61A denotes a slit; 61B denotes a linear capture portion (capturing member); 62 denotes a wiping sheet (movement controller); 63 denotes a foreign material holding container (foreign material container); 64 denotes non-return member (reverse-flow-restricting member); 70 denotes a discharge mechanism (discharging unit).

FIGS. 14 and 15 show a developing device 203 which includes a foreign material capture and removal mechanism 603 which is configured differently.

FIG. 14 is a plan view of a toner container of the developing device 203, and FIG. 15 is a sectional view thereof. In the figures, like reference numerals are given to like portions or units to those described in the above configuration examples.

The developing device 203 shown in FIGS. 14 and 15 is, as with the above developing device 202, such that a fixture of toner and carriers is supplied and includes a discharge mechanism 70 for developer. In addition, this configuration example is such that a rear space 21R constitutes the primary chamber of the invention, a rear auger 25R constitutes the developer-conveying unit of the invention, and a communicating portion 21Ab constitutes the migration opening of the invention.

A filter 61 provided in the communicating portion 21Ab is bent at an upper portion thereof, so that a distal end thereof is made to extend rearwards in a substantially horizontal direction to reach an upper side of the discharge mechanism 70.

The discharge mechanism 70 includes a rotational brush 65 which is provided on an upper side of a discharge auger 71 in such a manner as to be brought into contact with a lower surface of the filter 61 and a scraper 66 which is disposed in a position where the scraper 66 interferes with the rotational brush 65.

The rotational brush 65 is designed to be driven to rotate in a direction indicated by an arrow in the figure (in the same direction as a direction in which foreign materials are removed) in synchronism with the discharge auger 71.

In the developing device 203 that is configured as has been described above, the filter 61 captures foreign materials such as paper dust which are mixed into developer which circulates in an interior of developing housing 21, and the foreign materials captured by the filter 61 are removed along the filter 61 to an upper side thereof by a wiping sheet 62. Since the wiping sheet 62 pushes upwards the foreign materials sequentially from bottom or a lower portion, foreign materials are pushed by foreign materials lying underneath them to thereby be removed along the filter 61 and eventually reach an upper side of the discharge mechanism 70. Then, the foreign materials which are removed thereto along the filter 61 are scraped off by the rotational brush 65, and foreign materials caught in the rotational brush 65 are removed by the scraper 66, so as to be held in a recovering box, not shown, together with waste developer by the discharge mechanism 70.

Note that the invention is not limited to the exemplary embodiments that have been described heretofore but can be modified variously.

What is claimed is:

1. A developing device comprising:

a developing member that forms a toner image on a surface of a toner image carrier holding the toner image;

a developer container that holds a developer comprising a toner wherein the developer container includes a partition member that partitions an interior of the developer container into a primary chamber and a secondary chamber, a collected-toner-receiving port through which a collected toner that is collected from the toner image carrier is received into the developer container, and a migration opening through which the developer held in the primary chamber is migratable to the secondary chamber, the migration opening being disposed on the partition member;

a developer-conveying unit that is disposed in the primary chamber so as to convey the developer;

a capturing unit that is disposed at the migration opening and captures a foreign material which migrates through the migration opening together with the developer; and a foreign-material-removing unit that is disposed at the developer-conveying unit and moves the foreign material that is captured by the capturing unit out of the developer container while the foreign-material-removing unit moves and contacts the capturing unit so as to remove the foreign material.

2. The developing device according to claim 1, wherein the capturing unit comprises a capturing member that extends from the migration opening to outside the developer container; and the foreign-material-removing unit comprises a movement controller that moves along the capturing member so as to move the foreign material captured by the capturing member along the capturing member out of the developer container.

3. The developing device according to claim 1, further comprising:

a reverse-flow-restricting member that restricts a reverse flow of the foreign material, which is moved out of the developer container by the foreign-material-removing unit, into the interior of the developer container.

4. The developing device according to claim 1, further comprising:

a foreign material container that holds the foreign material removed by the foreign-material removing unit.

5. A developing device comprising:

a developing member that forms a toner image on a surface of a toner image carrier holding the toner image;

a developer container that holds a developer comprising a toner wherein the developer container includes a partition member that partitions an interior of the developer container into a primary chamber and a secondary chamber, a collected-toner receiving port through which a collected toner that is collected from the toner image carrier is received into the developer container, a migration opening disposed on the partition member through which the developer held in the primary chamber is migratable to the secondary chamber, and a developer-supplying port through which the developer comprising the toner is supplied;

a developer-conveying unit that is disposed in the primary chamber so as to convey the developer;

a capturing unit that is disposed at the migration opening and captures a foreign material which migrates through the migration opening together with the developer;

a foreign-material-removing unit that is disposed at the developer-conveying unit and moves the foreign material that is captured by the capturing unit out of the developer while the foreign-material-removing unit moves and contacts the capturing unit so as to remove the foreign material; and a discharging unit that discharges a redundant developer out of the developer container, the foreign material removing unit moving the removed foreign material to the discharging unit.

6. A developing device comprising:

a developing member that forms a toner image on a surface of a toner image carrier holding the toner image;

a developer container that holds a developer comprising a toner wherein the developer container includes a partition member that partitions an interior of the developer container into a primary chamber and a secondary chamber, a collected-toner-receiving port through which a collected toner that is collected from the toner image carrier is received into the developer container, and a migration opening through which the developer held in the primary chamber is migratable to the secondary chamber, the migration opening being disposed on the partition member;

a developer-conveying unit that is disposed in the primary chamber so as to convey the developer;

a capturing unit that is disposed in a conveying pathway of the toner, captures a foreign material and defines a plurality of openings though which the toner is migratable;

a foreign-material-removing unit that is disposed at the developer-conveying unit and moves the foreign material that is captured by the capturing unit out of the developer container while the foreign-material-removing unit moves and contacts the capturing unit so as to remove the foreign material; and a foreign material container that holds the foreign material which is removed out of the developer container, wherein the portion of the capturing unit defining the plurality of openings extends to inside the foreign material container.

7. An image-forming apparatus comprising:

a toner image carrier that holds a toner image;

a developing device that forms a toner image on a surface of the toner image carrier;

a cleaning device that cleans the surface of the toner image carrier by removing and collecting a toner on the toner image carrier; and a collected-toner-conveying mechanism that conveys the toner collected by the cleaning device to the developing device, wherein the developing device comprises:

a developing member that forms the toner image on the surface of the toner image carrier;

a developer container that holds a developer comprising the toner wherein the developer container includes a partition member that partitions an interior of the developer container into a primary chamber and a secondary chamber, and a migration opening through which the developer held in the primary chamber is migratable to the secondary chamber, the migration opening being disposed on the partition member;

a developer-conveying unit that is disposed in the primary chamber so as to convey the developer;

a capturing unit that is disposed at the migration opening and captures a foreign material which migrates through the migration opening together with the developer; and a foreign-material-removing unit that is disposed at the developer-conveying unit and moves the foreign material that is captured by the capturing unit out of the developer container while the foreign-material-removing unit moves and contacts the capturing unit so as to remove the foreign material.

8. An image-forming apparatus comprising:

a toner image carrier that holds a toner image;

a developing device that forms a toner image on a surface of the toner image carrier;

a developer-supplying device that supplies the developing device with a developer comprising a toner;

a cleaning device that cleans the surface of the toner image carrier by removing and collecting the toner on the toner image carrier; and a collected-toner-conveying mechanism that conveys the toner collected by the cleaning device to the developing device, wherein the developing device comprises:

a developing member that forms the toner image on the surface of the toner image carrier;

a developer container that holds the developer comprising the toner wherein the developer container includes a partition member that partitions an interior of the developer container into a primary chamber and a secondary chamber, and a migration opening through which the developer held in the primary chamber is migratable to the secondary chamber, the migration opening being disposed on the partition member;

a developer-conveying unit that is disposed in the primary chamber so as to convey the developer;

a capturing unit that is disposed at the migration opening and captures a foreign material which migrates through the migration opening together with the developer;

a discharging unit that discharges a redundant developer out of the developer container; and a foreign-material-removing unit that is disposed at the developer-conveying unit and moves the foreign material that is captured by the capturing unit to the discharging unit while the foreign-material-removing unit moves and contacts the capturing unit so as to remove the foreign material.

9. The developing device according to claim 1, wherein the capturing unit includes a filter defining slits and wherein the foreign-material-removing unit includes a wiping sheet that wipes the capturing unit in a direction of the slits to move the foreign material out of the developer container.

10. The developing device according to claim 9, wherein the wiping sheet includes an elastically deformable sheet.

11. The developing device according to claim 1, further comprising a foreign material container outside the developer container that holds the foreign material which is removed out of the developer container, wherein the capturing unit extends through an opening to the foreign material container.

12. The developing device according to claim 11, further comprising a reverse-flow-restricting member that restricts the foreign material from flowing from the foreign material container back into the developer container.

13. The developing device according to claim 12, wherein the reverse-flow-restricting member includes an elastic member covering the opening and having a cut therein through which the capturing unit extends.

14. The developing device according to claim 1, wherein a length of the developer container covers longitudinally the length of the toner image carrier, wherein the partition member partitions the developer container in the length direction into the primary and secondary chambers, and wherein the developer-conveying unit disposed in the primary chamber conveys the developer in the length direction.

15. The developing device according to claim 14, further comprising a second developer-conveying unit that is disposed in the secondary chamber so as to convey the developer in a direction opposite to the direction that the developer is conveyed in the primary chamber.

16. The developing device according to claim 15, wherein the developer container defines a second migration opening through which the developer held in the secondary chamber is migratable to the chamber such that the developer can circulate in the developer container

17. The developing device according to claim 14, wherein the developer-conveying unit and the second developer-conveying unit each include a screw auger that rotate to convey the developer.

18. The developing device according to claim 1, wherein the developer-conveying unit rotates so as to convey the developer, and wherein the foreign-material-removing unit operates in accordance with the rotation of the developer-conveying unit so as to remove the foreign material.

* * * * *